US005331914A

United States Patent [19]

Salmons

[11] Patent Number: 5,331,914

[45] Date of Patent: Jul. 26, 1994

[54] HIGHLY STABLE ONE-MAN BOAT

[76] Inventor: Larry W. Salmons, 25945 Kisker Rd., Platte City, Mo. 64079

[21] Appl. No.: 981,254

[22] Filed: Nov. 25, 1992

[51] Int. Cl.[5] ..... B63B 3/00

[52] U.S. Cl. ..... 114/346; 114/125; 114/363; 440/6

[58] Field of Search ..... 114/346, 39.1, 125, 114/363; 440/6, 21, 25, 26, 54; 441/37, 43, 44, 45, 46

[56] References Cited

U.S. PATENT DOCUMENTS

| | | | |
|---|---|---|---|
| 2,312,567 | 3/1943 | Lyon | 114/39.1 |
| 2,791,981 | 5/1957 | Lane | 114/346 |
| 2,928,108 | 3/1960 | Cochrane et al. | 114/125 |
| 3,335,436 | 8/1967 | Sharp | 114/346 |
| 3,468,276 | 9/1969 | Pollard et al. | 114/346 |
| 4,734,066 | 3/1988 | Burgess | 440/54 |
| 4,936,243 | 6/1990 | Shields | 114/363 |

FOREIGN PATENT DOCUMENTS

| | | | |
|---|---|---|---|
| 545046 | 8/1956 | Belgium | 114/346 |
| 3424807 | 1/1986 | Fed. Rep. of Germany | 114/346 |
| 2526395 | 11/1983 | France | 114/346 |
| 4185593 | 7/1992 | Japan | 114/363 |

*Primary Examiner*—Michael S. Huppert
*Assistant Examiner*—Thomas J. Brahan
*Attorney, Agent, or Firm*—Hovey, Williams, Timmons & Collins

[57] ABSTRACT

The boat has a circular hull which rotatably supports an overlying deck and its attached pedestal seat for rotation about an upright axis concentric with the center axis of the hull. For steering the boat, an electrically powered trolling motor secured to the deck is turned into a new selected direction of travel by the operator merely swiveling his seat, causing rotation of the deck relative to the hull and avoiding the need to turn the hull itself within the water. Preferably, the motor is built into the seat assembly in such a way that when the operator sits on the seat, the motor is depressed down out of a storage recess on the underside of the boat and into an operating position, and when the operator is off the seat, the motor is spring biased back up into its stored position within the recess. A single access hatch opening in the deck may be selectively rotated into registration with any one of a number of below-deck compartments contained within the hull to permit the operator to access such compartments without leaving his seat or changing positions.

35 Claims, 3 Drawing Sheets

HIGHLY STABLE ONE-MAN BOAT

TECHNICAL FIELD

The present invention relates to portable, one-man boats of the type which are typically, but not exclusively, utilized on relatively small bodies of water such as ponds, streams, and lakes, or hard-to-reach areas.

BACKGROUND

One-man fishing boats which can be transported to the water's edge and launched without a boat trailer and a launch ramp are very popular in some circles since they enable the fisherman to get on the water without a major financial investment. They also allow him access to many smaller or hard to reach bodies of water that would be totally inaccessible with a full-size boat and trailer. Moreover, they provide a certain serenity and blending in with nature that is not always possible with a full-size rig having a noisy outboard motor.

However, one-man boats which are currently commercially available also have a number of shortcomings. For example, one type of such boat is known as a "floater" or "belly boat" in which the fisherman rides along in an inflated inner tube with his legs and feet dangling down below the tube. The fisherman frequently uses fins or other propelling devices secured to his feet or legs to propel the floater through the water when he wants to change from one fishing spot to the next. Obviously, the fisherman is seriously limited in the amount of equipment he can take along, and forcing him to partially submerge himself in order to make the floater work properly has a number of drawbacks. In addition, visibility is somewhat sacrificed, since eye level is so close to the water. Casting and retrieving may also be more difficult.

Another type of one-man craft is simply a very small boat in which the fisherman is completely up out of the water, riding inside the protected hull of the craft. Such boats are typically propelled either by small electric or gasoline motors, or by paddles and oars. However, while the fisherman remains high and dry out of the water in such a craft, its stability may be sacrificed because of the relatively elevated position of the operator. In many instances, the boat presents rather cramped quarters, particularly when tackle boxes, poles, and other items are carried on board.

SUMMARY OF THE PRESENT INVENTION

Accordingly, one important object of the present invention is to provide a new one-man boat in which the operator is comfortably seated high and dry on an elevated pedestal seat such as that found in bass boats and other fishing craft, yet which is exceptionally stable and very difficult to capsize.

Another important object of the present invention is to provide a boat of the foregoing type which is steered by the seated operator merely turning his seat in the desired direction without moving the hull at all, thereby obviating the need for any steering wheels, levers, or other types of manually operated controls that not only require extra attention on the part of the operator, but also consume a significant amount of the precious space available on the boat.

Other important objects of the present invention include, for example, providing storage areas below the main deck of the boat which are readily accessible by merely swiveling the seat and attached deck until a hatch on the deck aligns vertically with the selected storage compartment, providing a craft in which transport to and from the water's edge can be facilitated by simply standing the boat on its circular edge and rolling it along the ground, and providing a craft which affords the fisherman the overall comfort, security and convenience of a much larger boat without the inherent drawbacks that accompany such full-size boat.

In carrying out the above objects, and others not expressly delineated above, the present invention contemplates a boat with a circular hull on which a flat deck and its attached pedestal seat are supported for rotation about the upright, central axis of the hull. Such rotational movement of the seat and deck is used to correspondingly turn or steer a small, battery-powered motor mounted on the deck, but extending down into the water. By pushing with his feet against exposed portions of the hull, the seated operator can readily swivel the seat, deck, and motor into a new direction of forward travel without repositioning the hull itself. Because of its circular configuration, the hull is always headed in the right direction, even though it is never turned.

Notwithstanding the relatively high-riding seat for the operator, the boat is extremely stable due to an annular, self-filling flood chamber in the hull that automatically fills with water when the boat is launched and thus forms a ring of stabilizing ballast for the operator even in the roughest of conditions. The power controls for the electric motor, as well as a depth finder and other instrumentation, may be suitably mounted directly on the deck close beside the operator's seat so as to always be in perfect position for operation access, regardless of the direction of travel of the boat. A series of storage compartments, live wells, or other chambers may be located beneath the deck and normally covered thereby, with access being obtained via a single hatch opening in the deck which can be brought into vertical registration with the selected compartment or well by appropriately rotating the deck. One embodiment has the electric motor attached to the bottom of the seat pedestal, which is itself retractable and extendable above the level of the deck. Thus, when the operator sits on the seat and pushes it down into a more retracted position, the motor is correspondingly projected down out of a storage recess on the underside of the boat and is placed into an operating position. When the operator then rises off the seat, a coil spring returns the seat to its extended position, likewise returning the motor up into its stowed location. In the alternative, a conventional trolling motor may be mounted on the deck and suspended over the side of the hull to propel the boat, yet carry out the relatively effortless, hands-free steering obtainable by merely swiveling the seat and the deck into a selected position relative to the hull.

Other features and benefits of the present invention will become apparent from the description which follows:

DETAILED DESCRIPTION

Figure 5:
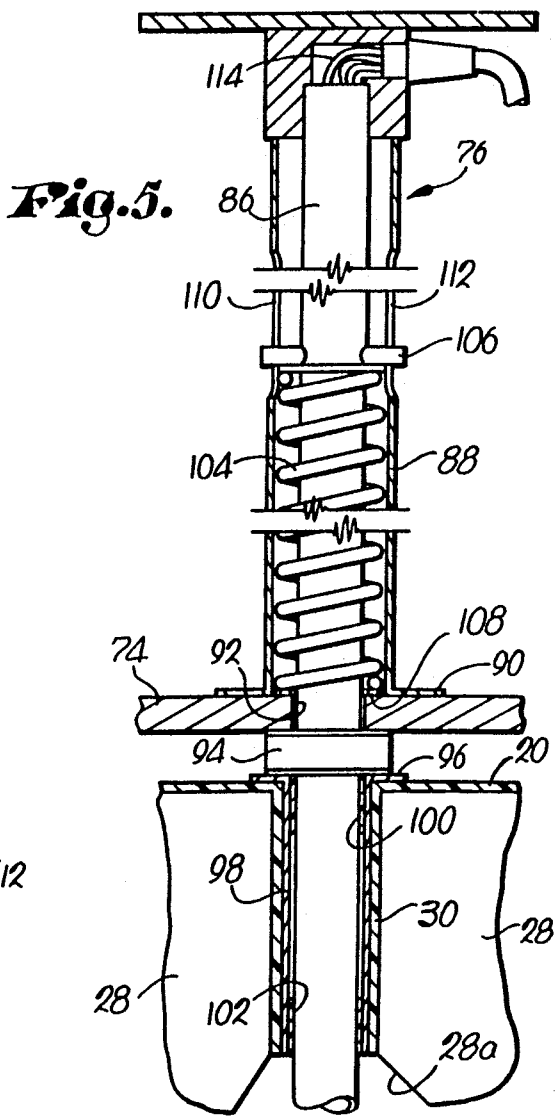
FIG. 5 is an enlarged, fragmentary vertical cross-sectional of the seat assembly in a compressed condition.

The one-man boat of the present invention includes a circular hull broadly denoted by the numeral 10 having an outer annular sidewall 12 and an inner annular sidewall 14 which cooperate to define an annulus 16. A bottom wall 18 extends completely across the bottom of the hull 10 to provide a closed bottom for the boat, except for certain open or cutout areas in the bottom wall, as will be subsequently described. Likewise, a top wall 20 covers the top of the hull 10 and completely spans the distance between diametrically opposed portions of the outer sidewall 12 so as to present a closed top for the hull, except for a number of special openings, as will also be described below. As a result of this construction, the annulus 16 is closed along its top, bottom, and opposite sides so as to present a convenient place to locate buoyancy means in the nature of a ring of foam material 22 disposed immediately below the top wall 20. Such foam ring 22 occupies only the top half of the annulus 16, thus enabling the bottom half thereof to be utilized an annular flood chamber or ballast chamber 24. Preferably, the walls 12, 14, 18, and 20 of the hull 10 are constructed from a suitable synthetic resinous material so the hull 10 can be molded using conventional plastic molding techniques and equipment.

Figure 2:
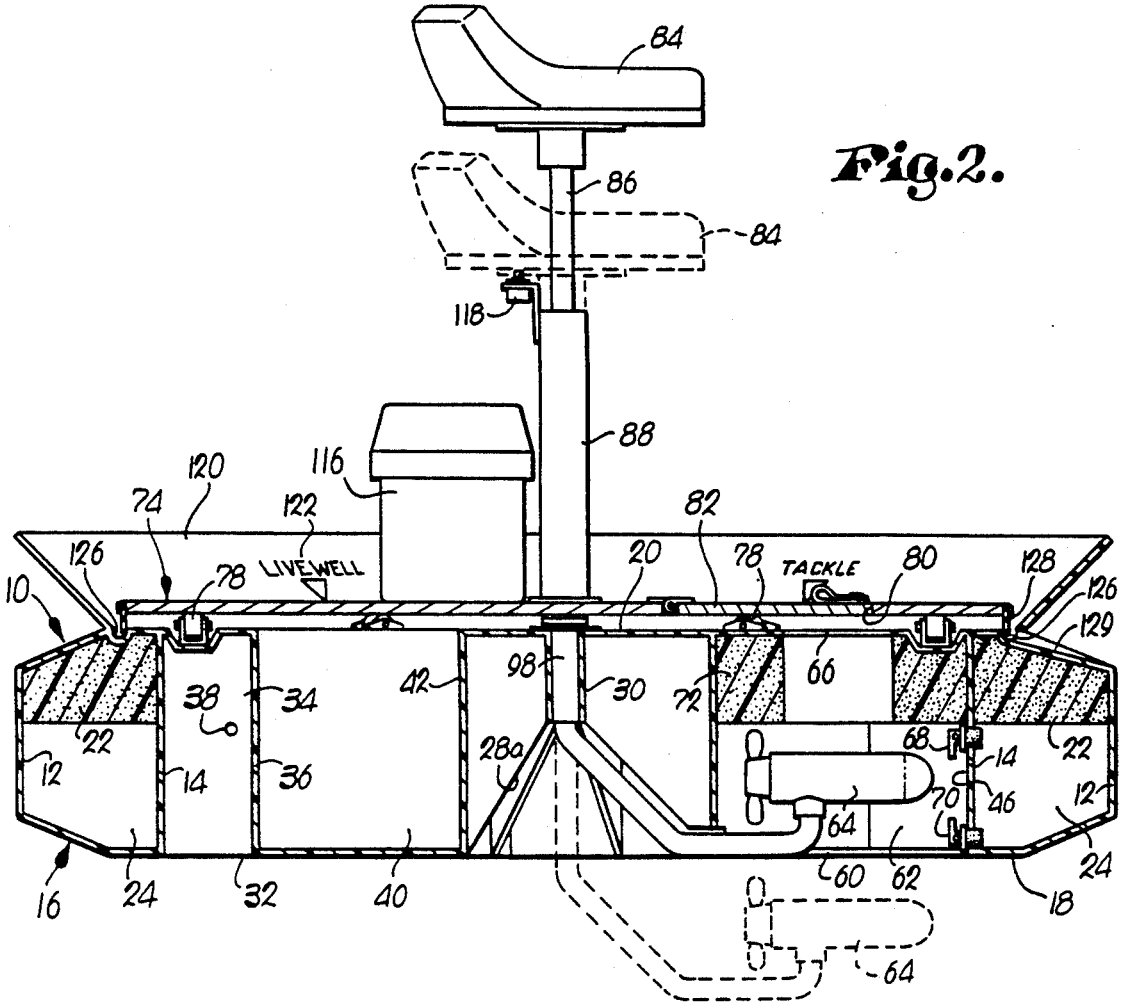
FIG. 2 is a transverse, vertical cross-sectional view through the boat, the phantom lines illustrating the lowered position of the seat when an operator is sitting thereon and the motor is pushed down out of its stowed position.
Figure 3:
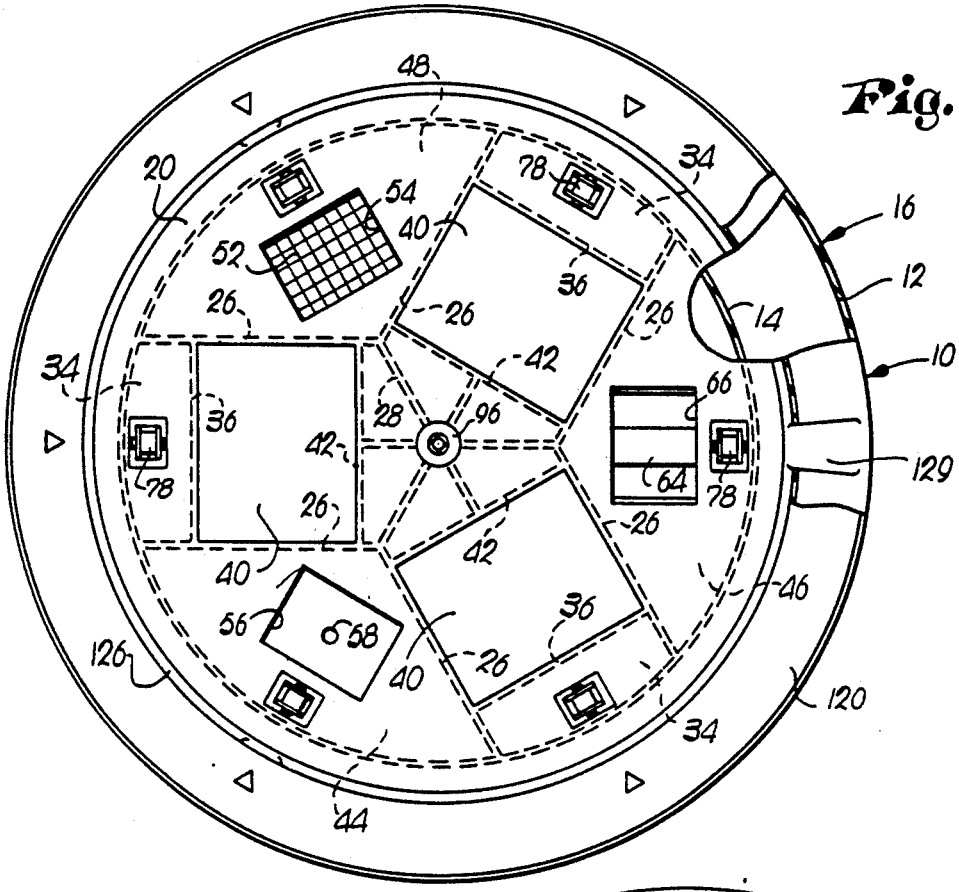
FIG. 3 is a top plan view of the hull of the boat with the seat and deck removed, portions of the hull being broken away to reveal details of construction.

The central area of the hull 10 is provided with a series of upright partitions 26 as shown in FIG. 3 which project obliquely inwardly from the inner wall 14 and intersect with one another and other upright partitions to define various compartments. The partitions 26 rigidly interconnect the bottom wall 18 and the top wall 20 so as to provide structural strength for the hull 10, and near the centermost part of the central area the partitions 26 are provided with six radial webs 28 that converge from the partitions 26 to a centermost, upright sleeve 30 which is open at its top intersection with the top wall 20 and which extends approximately half way down through the hull, as shown in FIGS. 2 and 5. The radially webs 28 have upwardly and inwardly extending, diagonal lower edges **28*a* that converge at and are fixedly joined to the lower termination of the sleeve 30. Thus, there is defined by the upwardly and inwardly converging edges 28*a* a generally cone like open area immediately below the lower termination of the sleeve 30** to provide operating clearance for the shaft of a trolling motor as will subsequently be described.

Figure 4:
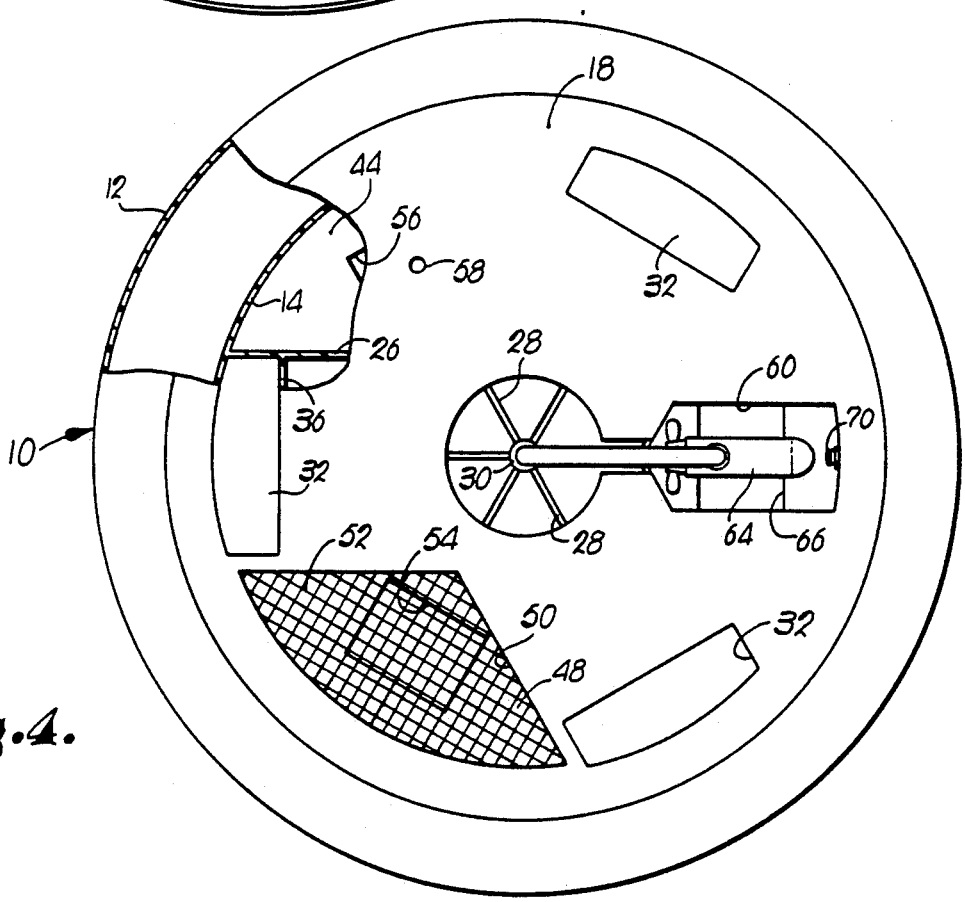
FIG. 4 is a bottom plan view of the hull with portions thereof broken away to reveal details of construction.

As illustrated in FIG. 4, the bottom wall 18 is provided with three, generally rectangular cutouts 32 arranged at 120° intervals about the central axis of the hull 10. Each of the cutouts 32 serves as the lower open end of an upright cavity 34 which extends up to the top wall 20 and is designed to be in open communication with the body of water when the boat is placed in use. As illustrated in FIG. 3, there are three of such cavities 34 spaced about the central axis of the hull 10 in registration with the cutouts 32, the opposite sides of each cavity 34 being defined by a pair of the partitions 26, the outer boundary being defined by the annular inner wall 14 of the hull 10, and the inner boundary by an upright, transverse wall 36 that spans the proximal pair of partitions 26. A vent hole 38 (FIG. 2) in each of the cavities 34 passes through one of the side partitions 26 and communicates the upper portion of each cavity 34 with the atmosphere.

Immediately radially inwardly from each of the cavities 34 is an open top dry well 40 of rectangular configuration. The bottom of each dry well 40 is closed by the bottom wall 18 of the hull, but the top is open to permit convenient access thereto, as will subsequently be described. A radially innermost transverse wall 42 for each dry well 40 spans the corresponding partitions 26 in parallel relationship with the outer transverse wall 36 so as to define the inner boundary of the dry well 40.

As a result of the inwardly converging nature of the partitions 26 between each pair of dry wells 40, three generally pie-shaped compartments 44, 46, and 48 are defined between the dry wells 40. These three different compartments may be used for a variety of purposes, such as live wells, bait storage, or dry storage. For example, the compartment 48 has been illustrated as being set up for use as a live well for storing live fish after they have been caught, and for this purpose a generally triangular shaped opening 50 (FIG. 4) is provided in the bottom wall 18 in the area of the compartment 48 to admit ambient water. A screen 52 covers the opening 50 to prevent the escape of fish contained therein. At the other extreme, a rectangular hole 54 is provided in the top wall 20 of the hull 20 to provide access to the live well presented within the compartment 48.

The compartment 44 has been illustrated herein simply as a dry storage compartment, without any communication through the bottom wall 18 to the body of water in which the boat is placed. A rectangular access opening 56 in the top wall 20 allows access to the interior of the chamber 44. If desired, the chamber 44 may be utilized as a wet tank which can be filled via a suitably stoppered hole 58 in the bottom wall 18 of the hull.

In the embodiment illustrated in FIGS. 1–5, the compartment 46 has been modified for use in defining a storage recess for the operating head of an electric trolling motor for propelling the boat. Details of the motor will be described below. Insofar as the storage recess is concerned, it will be noted that the bottom wall 18 has an elongated opening 60 therein with the longitudinal axis of the opening 60 extending in a generally radial direction. Such opening 60 forms the entry to an open bottom recess 62 which will fully accommodate and accept the head 64 of the trolling motor when the motor is placed in its standby or stored position. A rectangular hole 66 in the top wall 20 allows access to the recess 62 for purposes of either working on the motor head 64 or inserting and removing plugs 68 and 70 in holes within the inner annular sidewall 14. Such plugs 68 and 70 control the filling and discharge of ballast water in the flood chamber 24. If desired, all three of the pie-shaped compartments 44, 46, and 48 may be provided with flotation foam in the upper portion thereof, as typified by the section of foam 72 illustrated within the compartment 46 in FIG. 2.

The second major component of the boat, in addition to the circular hull 10, is a support for the operator of the boat, herein illustrated as comprising a circular deck 74 and a pedestal seat assembly 76. As will be seen below, the deck 74 and the seat assembly 76 are securely interconnected for conjoint rotation relative to the hull 10 about an upright axis that also defines the center of the hull 10.

The deck 74 is somewhat smaller in diameter than the hull 10 and is concentrically disposed with respect thereto as above noted. It overlies the top wall 20 of the hull 10 and is supported for rotation relative thereto by six rollers 78 which are attached to the top wall 20 at 60° intervals in underlying relationship with the outer peripheral margin of the deck 74. The deck 74 itself comprises a flat piece of sheet material such as plywood or other suitable substance and is provided with a rectangular hatch opening 80 normally closed by a hinged door 82. The opening 80 is so positioned radially outwardly from the upright axis of the deck 74 that opening 80 may be selectively brought into vertical registration with any selected one of the compartments and access openings thereto below the deck 74.

The seat assembly 76 includes a cushioned seat 84 of any suitable design secured to the uppermost end of an upright tube member 86 that is telescopically received within a larger, upstanding, tubular pedestal 88. The lower end of the pedestal 88 has a flange 90 that is bolted or otherwise securely fastened to the deck 74 such that the pedestal 88 is caused to rotate with the deck 74 when the latter rotates about its upright axis of rotation. The tubular member 86 is concentrically housed within the pedestal 88 and passes completely downwardly therethrough and through an opening 92 (FIG. 5) in the deck 74 and thence downwardly into the sleeve 30 of the hull 10. As illustrated in FIG. 5, a thrust bearing 94 surrounds the member 86 immediately below the deck 74 to absorb some of the load of the latter and, in turn, rests upon the outturned circular flange 96 of a metal sleeve 98 pressed into the plastic sleeve 30 and substantially coextensive therewith. A pair of upper and lower nylon bushings 100 and 102, respectively, are disposed at upper and lower ends of the metal sleeve 98 and journal the member 86 for rotation within the plastic sleeve 30. A coil spring 104 housed within the pedestal 88 is trapped between a crosspin 106 of the member 86 and a washer 108 at the inside lower extremity of the pedestal 88 to yieldably urge the member 86 and thus its attached seat 84 to the upwardly extended full line position illustrated in FIGS. 1 and 2. The cross pin 106 moves within opposite upright slots 110 and 112 in the pedestal 88 so as to prevent relative rotation between the member 86 and the pedestal 88, yet permit telescoping action of the member 86 relative to the pedestal 88. As a consequence, when the seat 84 is rotated, the deck 74 rotates with it.

As illustrated in FIGS. 2 and 4, the tubular member 86 of the seat 84 extends completely on down through the plastic sleeve 30 and is provided with an outturned leg at its lower end which ultimately connects with the motor head 64 of the trolling motor. Consequently, in the illustrated embodiment, the telescoping action of the tubular member 86 may be utilized to raise and lower the motor head 64 into and out of its storage recess 62 as illustrated in FIG. 2. In addition, rotation of the deck 74 and the seat assembly 76 when the seat 84 is fully depressed and the motor head 64 is down out of the recess 62 as shown in FIG. 2 causes the motor head 64 to be repositioned relative to the hull 10, thus steering the latter. As shown in FIG. 5, the tubular nature of the member 86 may be utilized to good advantage by housing the electrical conductors 114 which connect the motor head 64 with a source of electric power, such as the DC battery 116 illustrated in FIGS. 1 and 2. A switch 118 secured to the upper end of the pedestal 88 may be positioned for actuation by the seat 84 when the latter is fully depressed so as to energize the motor 64 when the seat is in its lowered position and to deenergize the motor 64 when the seat is raised.

In order to facilitate rotation of the deck 74 and seat assembly 76 relative to the hull 10, the hull 10 is provided with an upwardly and outwardly angled annular collar 120 located radially outboard of the deck 74 and projecting upwardly beyond the latter. It will be noted that the collar 120 is conveniently positioned to enable an operator sitting on the seat 84 to engage the collar 120 with his feet and exert a pushing action in either a left or right direction to correspondingly turn the deck. Non-slip strips of material or other friction enhancing means may be provided on the collar 120 to enhance traction. Furthermore, the inner inclined face of the collar 120 serves as a convenient location for indicia 122 such as "Cooler", "Cleaning Well", "Cargo", "Live Well", "Tackle", etc., along with appropriate arrowheads, to indicate the location of the under-deck compartment nearest to such indicia. A matching, oppositely directed arrowhead 124 (FIG. 1) on the deck 74 directly radially outboard from the hatch opening 80 is adapted to be aligned with a selected one of the arrowhead indicia on the collar 120 to bring the hatch opening 80 into overhead alignment with the appropriate below-deck compartment as indicated by the indicia.

The collar 120 also serves as a splash ring to help prevent the taking on of water over the upper side edges of the hull during use of the boat. The annular, notch around the hull 10 immediately below the collar 120 is helpful in this regard. In the event any water is shipped in, such moisture will collect in a drain ring 126 which is recessed into the top wall 20 around the outer periphery of the deck 74. A number of water discharge spillways 129 are molded into the notched portion of the hole immediately below the collar 120 at spaced locations around the hull to communicate with the drain ring 126 and provide a way of discharging collected water from that area of the boat. As illustrated in FIG. 2, a depending rubber skirt 128 may be secured to the outer circumferential edge of the deck 74 and project down into the drain ring 126 to prevent water from splashing into the area beneath the deck 74 and around the thrust bearing 94.

Figure 1:
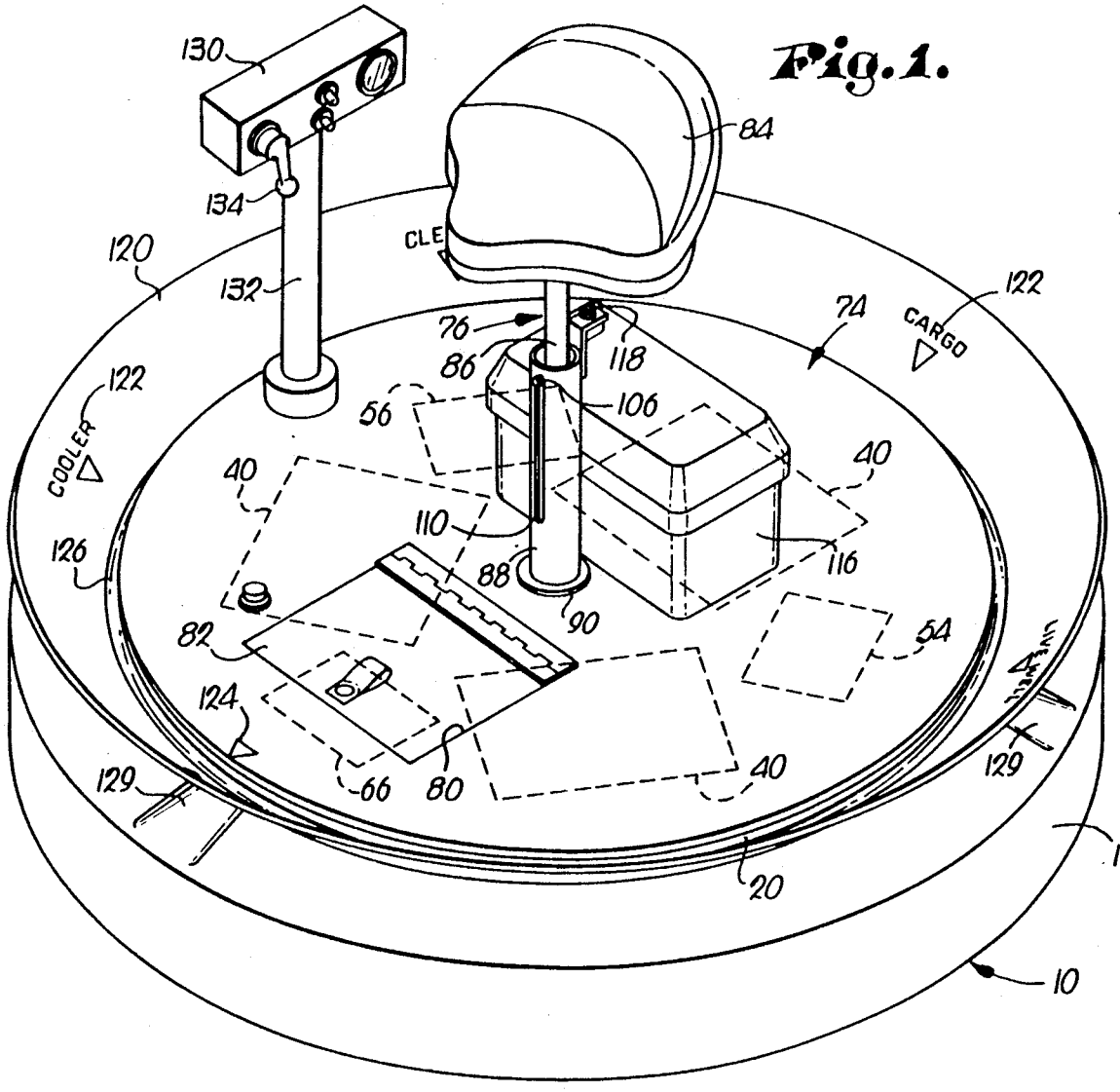
FIG. 1 is a left front perspective view of a one-man boat constructed in accordance with the principles of the present invention.

As illustrated in FIG. 1, the operating controls for the boat may be conveniently placed immediately adjacent the seat 84, such controls in the illustrated embodiment taking the form of a control box 130 supported at the upper end of a pedestal 132 on the deck 74. In addition to depth gauges and other instrumentation, the control box 130 may be provided with a speed control knob 134 for the trolling motor head 64.

OPERATION

Because of the circular nature of the hull 10, getting the boat down to the water's edge may be facilitated by standing the boat on edge and rolling it in the upstanding condition down to the water. Once the edge of the water is reached, the boat is simply laid down flat and shoved into the water, whereupon the trolling motor battery 116 is added and the appropriate leads are connected to provide a source of power for the trolling motor head 64. By removing the plugs 68 and 70 (FIG. 2) prior to placing the boat in the water, the boat is immediately prepared to start filling the flood chamber 24 as soon as the hull engages the water.

After loading up the various storage compartments beneath the deck 74, the fisherman may push off the shore and enter water deep enough to clear the trolling motor head 64 when the operator sits on the seat 84. Once the motor 64 is lowered down into its phantom line operating position of FIG. 2, manipulation of the speed control knob 134 will result in speed variation of the motor 64 because the energizing circuit has been closed as a result of depression of the seat switch 118.

To change directions of travel of the boat, the operator need only swivel the seat 84 into the selected direction so that the operator is facing the direction of intended travel. By pushing with his feet against the collar 120, the seat assembly 76 and the deck 74 will rotate about their upright axis relative to the hull 10 and cause corresponding repositioning rotation of the motor head 64. Thus, even though the hull 10 will not have been rotated, the operator will be facing in a different direction and the trolling motor head 64 will be appropriately lined up such that actuation of the control knob 134 will then cause the boat to move forwardly in the new direction. Thus, change of direction is accomplished without any splashing or shifting around of the hull itself, resulting in a very quiet, stealth-like operation that is conducive to good fishing results.

It will be appreciated that due to its circular configuration, the hull 10 is always properly oriented for a change in direction. There is no pointed bow, blunt stern, or flat sides to be concerned with since the hull is fully symmmetrical. Any portion of its periphery can serve as the stern or bow of the boat at any time without adversely affecting the mobility or maneuverability of the craft.

It should also be apparent that the various compartments below the deck are well protected and provide an uncluttered fishing area for the fisherman without sacrificing ease of access to such compartments. By merely rotating the deck 74 until the arrow 124 is aligned with the appropriate indicia 122 on the circumscribing collar 120, the hatch 80 will be aligned with the appropriately selected compartment. Opening of the hatch door 82 gains immediate access to the compartment therebelow the operator without the operator ever leaving the seat 84 or straining himself by trying to reach out of the way places.

Furthermore, it will be appreciated that even though the boat of the present invention is a relatively small craft, it is exceptionally stable and the fisherman enjoys the comfort and benefits associated with sitting up high and dry out of the water on a pedestal seat similar to that employed in many bass boats. Due to the presence of the flood tank 24, the overall center of gravity of the boat when in the water is substantially lower than it would otherwise be. Furthermore, in the event a wave attempts to rock the boat or the operator stands on one edge of the boat, the side attempting to be raised up will have to overcome the extra weight and ballast provided by the full flood tank 24 in that area. Moreover, the buoyant foam ring must be pushed down into the water as the far side is attempted to be raised, which is resisted by the buoyancy of the foam. Consequently, there is a resistance to rocking and a surprising exceptional degree of stability provided for the craft, notwithstanding the elevated position of the operator.

When it is time to remove the boat from the water, it is desirable to first drain the flood chamber 24 to reduce the overall weight of the boat. It will be appreciated in this respect that once the operator climbs out of the boat and onto the shore, the overall level of the boat in the water will rise such that some of the trapped water within the flood chamber 24 automatically drains out through the lower hole normally closed by the plug 70 as the water within the flood chamber 24 seeks to equalize with the level of the water outside the craft. Any water left in the flood chamber after a few minutes can then easily be allowed to drain out after the craft is pulled up on shore and before it is up-ended to be rolled back up into the transporting vehicle.

ALTERNATE EMBODIMENT OF FIG. 6

Figure 6:
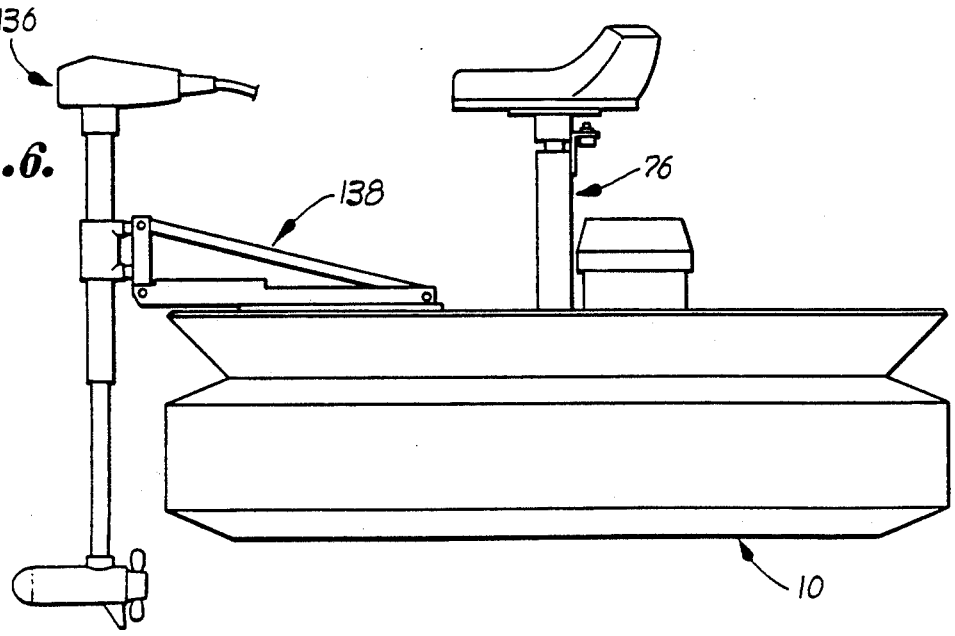
FIG. 6 is a side elevational view of the boat on a reduced scale illustrating an alternative embodiment in which a standard trolling motor is attached to the deck in lieu of the seat-mounted motor of the first embodiment.

FIG. 6 illustrates a boat which is identical in all respects to the boat of FIGS. 1–5 with the exception that the means of propulsion are not built into the seat assembly 76. Instead, a separate trolling motor 136 of conventional design is hung over the edge of the hull 10 via a mounting assembly 138 attached to the deck 74. Thus, the motor 136 is still repositioned relative to the hull for steering purposes when the deck 74 and the seat assembly 76 are rotated, as in the first embodiment. Preferably, the mounting assembly 138 is such that the trolling motor 136 can be swung up and laid on the deck in a stored position to facilitate launching and recovery of the boat.

It should also be pointed out that although the deck 74 and below deck compartments have been illustrated herein in connection with a one-man boat having a circular hull, the concept of having a deck which can be indexed into a selected position to align an access hatch in the deck with a compartment therebelow is not limited to such a one-man boat. Indeed, such concepts may find utility in conventional bass boats or other similar fishing crafts wherein it would be desirable to obtain the storage and access benefits of such an arrangement without necessarily causing concurrent steering of the craft.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

I claim:

1. In a relatively small, yet highly stable, one-man boat, the improvement comprising:

a hull having flotation means to provide buoyancy when the boat is placed in a body of water;

a support for the operator of the boat, said support being carried by the hull and rotatable relative thereto about an upright axis into any one of a number of selectable positions; and means for securing a motor to the support for propelling the boat through the water, said motor being adapted for moving with the support during rotation thereof whereby to permit the operator to steer the boat by rotating the support into a selected position without changing the orientation of the hull, said support including a seat spaced above the hull and located at least generally on said axis of rotation of the support for supporting the operator in an elevated sitting position during use, said hull having a portion thereof exposed and accessible to the feet of the operator when in said elevated sitting position to permit hands-free steering of the boat as the seated operator pushes against the exposed portion of the hull with his feet to rotate the support, its seat and the motor into a new position relative to the hull, said hull further including an annular ballast chamber circumscribing said upright axis and spaced radially outwardly therefrom below the normal water line of the hull when in use for stabilizing the boat notwithstanding the elevated position of the operator.

2. In a boat as claimed in claim 1, said support further including a deck upon which the seat is mounted for rotation therewith.

3. In a boat as claimed in claim 2, said hull being circular with its center on said axis of rotation of the deck.

4. In a boat as claimed in claim 3, said deck being circular with its center on said axis of rotation.

5. In a boat as claimed in claim 4, said hull being larger in diameter than the deck, said portion of the hull comprising a peripheral hull portion which circumscribes the periphery of the deck and projects upwardly beyond the same.

6. In a boat as claimed in claim 1, said support including a flat deck with said seat carried by the deck above the latter, said means for securing a motor to the support including an upright member extending through the deck and projecting in opposite directions above and below the deck, said member having an upper end secured to the seat and a lower end secured to an electric motor.

7. In a boat as claimed in claim 1, said ballast chamber including port means positioned to permit natural inflow and outflow of ballast water in accordance with the depth of penetration of the hull into the body of water.

8. In a boat as claimed in claim 7, said floatation means being located at least in part in overlying relationship with said ballast chamber.

9. In a boat, the improvement comprising:

a hull having floatation means to provide buoyancy when the boat is placed in a body of water;

a support for the operator of the boat, said support being carried by the hull and rotatable relative thereto about an upright axis into any one of a number of selectable positions; and means for securing a motor to the support for propelling the boat through the water, said motor being adapted for moving with the support during rotation thereof whereby to permit the operator to steer the boat by rotating the support into a selected position without changing the orientation of the hull, said hull having means associated therewith defining a plurality of open top compartments arranged in an arcuate pattern about said upright axis, said support including a deck overlying said compartments in covering relationship therewith and having an access opening adapted to permit access by the operator to any selected one of said compartments by rotating the deck into a position in which the opening is aligned vertically with the open top of the selected compartment.

10. In a boat as claimed in claim 9, said deck having a door normally closing said access opening.

11. In a boat as claimed in claim 9, said hull being circular with its center on said axis of rotation of the deck.

12. In a boat as claimed in claim 11, said deck being circular with its center on said axis of rotation.

13. In a boat as claimed in claim 12, said support further including a seat secured to the deck and located at least generally on said axis of rotation.

14. In a boat as claimed in claim 13, said hull having a portion thereof accessible to the feet of an operator seated in said seat whereby to permit the seated operator to rotate the deck by pushing on said portion of the hull with his feet.

15. In a boat as claimed in claim 14, said hull being larger in diameter than the deck, said portion of the hull comprising a peripheral hull portion which circumscribes the periphery of the deck and projects upwardly beyond the same.

16. In a boat, the improvement comprising:

a hull having flotation means to provide buoyancy when the boat is placed in a body of water;

a support for the operator of the boat, said support being carried by the hull and rotatable relative thereto about an upright axis into any one of a number of selectable positions; and means for securing a motor to the support for propelling the boat through the water, said motor being adapted for moving with the support during rotation thereof whereby to permit the operator to steer the boat by rotating the support into a selected position without changing the orientation of the hull, said support including a flat deck and an operator'seat carried by the deck above the latter, said means for securing a motor to the support including an upright member extending through the deck and projecting in opposite directions above and below the deck, said member having an upper end secured to the seat and a lower end secured to an electric motor, said member having means yieldably biasing the same upwardly to maintain the seat in a raised position when the operator is off the seat, said hull having an open bottom, downwardly facing recess positioned to receive the electric motor for storage when the seat is in its raised position and to permit the motor to project downwardly below the recess into an operating disposition when the operator is sitting on the seat and the member and the seat are depressed into a lowered position against the action of the biasing means.

17. In a boat as claimed in claim 16, said upright member having switch means associated therewith for use in energizing the electric motor when the seat is in its lowered position.

18. In a boat as claimed in claim 16, said hull being circular with its center on said axis of rotation of the deck.

19. In a boat as claimed in claim 18, said deck being circular with its center on said axis of rotation.

20. In a boat as claimed in claim 19, said hull having a portion thereof accessible to the feet of an operator seated in said seat whereby to permit the seated operator to rotate the deck by pushing on said portion of the hull with his feet.

21. In a boat as claimed in claim 20, said hull being larger in diameter than the deck, said portion of the hull comprising a peripheral hull portion which circumscribes the periphery of the deck and projects upwardly beyond the same.

22. In a boat, the improvement comprising:

means defining a plurality of open top compartments arranged in an arcuate pattern about an upright axis;

a deck overlying said compartments in covering relationship therewith and supported for rotation about said upright axis;

an operator's seat secured to the deck for rotation therewith; and an access opening in the deck adapted to permit access by the operator to any selected one of said compartments by rotating the deck into a position in which the opening is aligned vertically with the open top of the selected compartment.

23. In a boat as claimed in claim 22, said deck having a door normally closing said access opening.

24. In a boat as claimed in claim 22, said seat being positioned on said upright axis.

25. In a boat as claimed in claim 22, the boat having a hull provided with flotation means which provides buoyancy for the boat, said hull supporting the deck for rotation between its selected positions of access.

26. In a boat as claimed in claim 25, said hull being circular with its center on said axis of rotation of the deck.

27. In a boat as claimed in claim 26, said deck having means for securing a motor thereto for propelling the boat through the water, said motor being adapted for moving with the deck during rotation thereof whereby to permit the operator to steer the boat by rotating the deck into a selected position without changing the orientation of the hull.

28. In a highly stable one-man boat, the improvement comprising:

a circular hull having flotation means to provide buoyancy when the boat is placed in a body of water;

a circular deck carried by the hull in concentric relationship therewith and rotatable relative thereto about an upright axis coinciding with the centers of the hull and the deck;

an operator's seat spaced above the deck and secured thereto at least generally on said upright axis so that the seat and the deck can rotate together relative to the hull, said hull having an annular peripheral portion circumscribing the deck and accessible to the feet of an operator sitting on the seat in an elevated position relative to the deck so that the operator may rotate the deck into any one of a number of selectable positions by pushing with his feet against the peripheral portion of the hull; and means for securing a motor to the deck for propelling the boat through the water and for steering the boat in a direction determined in accordance with the rotated position of the deck without changing the orientation of the hull, said hull including an annular ballast chamber concentric with said axis of rotation of the deck and adapted to admit and contain a quantity of water from the body of water in which the boat is placed during use whereby to stabilize the boat.

29. In a highly stable one-man boat, as claimed in claim 28, said ballast chamber including port means positioned to permit natural inflow and outflow of ballast water in accordance with the depth of penetration of the hull into the body of water.

30. In a highly stable one-man boat, the improvement comprising:

a circular hull having flotation means to provide buoyancy when the boat is placed in a body of water;

a circular deck carried by the hull in concentric relationship therewith and rotatable relative thereto about an upright axis coinciding with the centers of the hull and the deck;

an operator's seat secured to the deck at least generally on said upright axis so that the seat and the deck can rotate together relative to the hull, said hull having a peripheral portion thereof accessible to the feet of an operator sitting on the seat so that the operator may rotate the deck into any one of a number of selectable positions by pushing with his feet against the peripheral portion of the hull; and means for securing a motor to the deck for propelling the boat through the water and for steering the boat in a direction determined in accordance with the rotated position of the deck without changing orientation of the hull, the boat including a plurality of open top compartments arranged in an arcuate pattern about said upright axis and located beneath the deck such that the deck is disposed in covering relationship with the compartments, said deck having an access opening adapted to permit access by the operator to any selected one of said compartments by rotating the deck into a position in which the opening is aligned vertically with the open top of the selected compartment.

31. In a highly stable one-man boat, as claimed in claim 30, said hull including an annular ballast chamber concentric with said axis of rotation of the deck and adapted to admit and contain a quantity of water from the body of water in which the boat is placed during use whereby to stabilize the boat.

32. In a highly stable one-man boat as claimed in claim 31, said flotation means being located at least in part in overlying relationship with said ballast chamber.

33. In a highly stable one-man boat, as claimed in claim 32, said means for securing a motor to the deck including an upright member extending through the deck and projecting in opposite directions above and below the deck, said member having an upper end secured to the seat and a lower end secured to an electric motor.

34. In a highly stable one-man boat as claimed in claim 33, said member having means yieldably biasing the same upwardly to maintain the seat in a raised position when the operator is off the seat, said hull having an open bottom, downwardly facing recess positioned to receive the electric motor for storage when the seat is in its raised position and to permit the motor to project downwardly below the recess into an operating disposition when the operator is sitting on the seat and the member and the seat are depressed into a lowered position against the action of the biasing means.

35. In a boat as claimed in claim 34, said upright member having switch means associated therewith for use in energizing the electric motor when the seat is in its lowered position.

* * * * *